US007336245B2

(12) United States Patent
Kang

(10) Patent No.: US 7,336,245 B2
(45) Date of Patent: Feb. 26, 2008

(54) DISPLAY FOR USING PULSE WIDTH MODULATION TO REPRESENT BRIGHTNESS AND GRAY SCALES

(75) Inventor: Mun-Seok Kang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 549 days.

(21) Appl. No.: 11/046,618

(22) Filed: Jan. 27, 2005

(65) Prior Publication Data

US 2005/0168497 A1 Aug. 4, 2005

(30) Foreign Application Priority Data

Jan. 29, 2004 (KR) ..... 10-2004-0005731

(51) Int. Cl.
*G09G 3/20* (2006.01)
*G09G 5/00* (2006.01)

(52) U.S. Cl. ..... 345/75.2; 345/74.1; 345/75.1; 345/208; 345/212

(58) Field of Classification Search ..... 345/74.1, 345/75.1, 75.2, 690, 208, 212, 76–82
See application file for complete search history.

(56) References Cited

U.S. PATENT DOCUMENTS 6,329,759 B1 * 12/2001 Tanaka et al. ..... 315/169.3
6,972,741 B1 * 12/2005 Isono et al. ..... 345/75.2

* cited by examiner

*Primary Examiner*—Duc Q Dinh
(74) *Attorney, Agent, or Firm*—Christie, Parker & Hale, LLP

(57) ABSTRACT

An electron emission device (EED) includes a display panel, first and second electrode drivers, and a controller. The display panel includes first electrodes in the column direction, second electrodes in the row direction, and an electron emission source. The first and the second electrode drivers drive the first and the second electrodes. The controller receives first vertical and horizontal synchronous signals and an input signal including video data, regenerates a first vertical synchronous signal and a second horizontal synchronous signal according to a blank-time information of a blank-time for representing no gray scales of an image and an on-time information of an on-time for representing the gray scales thereof, generates the drive signal for driving the display panel based on the regenerated second vertical and horizontal synchronous signals, and outputs them to the first and second electrode drivers.

20 Claims, 6 Drawing Sheets

DISPLAY FOR USING PULSE WIDTH MODULATION TO REPRESENT BRIGHTNESS AND GRAY SCALES

CROSS REFERENCE TO RELATED APPLICATION

This application claims priority to and the benefit of Korean Patent Application No. 10-2004-0005731 filed on Jan. 29, 2004 in the Korean Intellectual Property Office, the entire content of which is incorporated herein by reference as if fully set forth herein.

BACKGROUND OF THE INVENTION

1. Field of the Invention

The present invention relates to a display. More specifically, the present invention relates to a display for using Pulse Width Modulation (PWM) to represent brightness and gray scales.

2. Description of the Related Art

In general, a flat panel display (FPD) is a display device in which walls are provided between two substrates to form an airtight device, and appropriate elements are arranged in the airtight device to display desired images. The importance of the FPD has been emphasized following the development of multimedia technologies. In response to this trend, various flat displays such as a liquid crystal display (LCD), a plasma display panel (PDP), and an electron emission device (EED) have been put to practical use.

In particular, since an electron emission device uses phosphorous emission caused by electron beams in a like manner of the cathode ray tube (CRT), it has a high probability of realizing a flat-type display which maintains excellent features of the CRT, provides no image distortion, and allows low power consumption. In particular, it satisfies view angle, high-rate response, high resolution, fineness, and slimness criteria, and accordingly, it has become the center of public attention as a next-generation display.

Generally, there are two kinds of EED. One uses a thermionic (or hot) cathode as an electron source and the other uses a cold cathode as an electron source. Also, in EEDs using a cold cathode, there are field emitter array (FEA) type EEDs, surface conduction emitter (SCE) type EEDs, metal-insulator-metal (MIM) or metal-insulator-semiconductor (MIS) type EEDs, and ballistic electron surface emitting (BSE) type EEDs.

A typical EED is composed of a triode structure having cathode, anode, and gate electrodes. More specifically, the cathode electrode (generally used as a data electrode) is formed on a substrate. An insulation layer has a contact hole. The contact hole and the gate electrode (generally used as a scan electrode) are integrated on the insulation layer. Additionally, an emitter used as an electron source is formed inside the contact hole and is connected to the cathode electrode. Alternatively, the gate electrode can be a data electrode and the cathode electrode can be a scan electrode. As such, a cathode electrode can be one of a scan electrode and a data electrode, and a gate electrode can be the other one of the scan electrode and the data electorde according to the structure of the EED.

In operation, an electron emission display using the above described configuration concentrates high fields on an acute cathode, that is, an emitter, to emit electrons according to the quantum-mechanical tunnel effect. The electrons emitted from the emitter are accelerated by the voltage applied between the cathode electrode and an anode electrode and are collided with a red, green, and blue (RGB) phosphor layer formed on the anode electrode, thereby emitting one or more lights to display one or more images.

FIG. 1 and FIG. 2 represent a conventional EED 100. FIG. 1 is a partial perspective view of a display panel of the conventional EED 100 and FIG. 2 is a cross-sectional view of a pixel part of the conventional EED100.

As illustrated in FIG. 1 and FIG. 2, the conventional EED 100 includes a rear substrate 1 and a front substrate 2. In addition, the EED 100 includes an emitter 30 (shown in FIG. 2) that function as an electron emission source and electrodes to emit electrons 60 from the emitter. The electrodes include a cathode electrode 10 and a gate electrode 20 that are formed on the rear substrate 1. On the front substrate 2, facing the rear substrate 1, an anode electrode 40 for attracting the electrons 60 emitted from the emitter 30 is formed, and a phosphor layer 50 including RGB phosphors against which the emitted electrons 60 collide and emit light(s) is formed on the anode electrode.

In an EED, brightness and gray scales of images made by the collision of emitted electrons with a phosphor layer and an emission of the phosphors of the phosphor layer are varied according to the input digital video signal. To control the brightness and the gray scales represented by the digital video signal, conventionally Pulse Width Modulation (PWM) and Pulse Amplitude Modulation (PAM) are used.

The PWM is a method for modulating a pulse width of a driving waveform applied to a corresponding electrode according to digital video signals input by a driver to allow emission of a predetermined amount of electrons and control the time of emission, and the PAM is a method for modulating the amplitude of a driving waveform applied to a corresponding electrode by the driver to maintain the time of emission at a predetermined rate and control the amount of momentary electron emission.

In the case of driving a data line using the PWM, conventionally based on an input horizontal synchronous signal together with a video signal, a pulse for representing gray scales is generated. But when the input synchronous signal is unstable and changes, the period or the duration of the active period of the horizontal synchronous signal can be lower than a constant on-time (and/or blank-time) for representing full gray scales and/or 256 gray scales. On this account, the pulse of an upper portion of the lower gray scales cannot be properly represented, therefore full gray scales and brightness can be decreased.

SUMMARY OF THE INVENTION

It is an aspect of the present invention to provide a display for preventing a variation of gray scales and a variation of brightness of the display, and having a constant brightness and the gray scales even when an input synchronous signal is unstable or varies.

In one exemplary embodiment of the present invention, a display includes a display panel having first electrodes provided in the column direction, second electrodes provided in the row direction, and an electron emission source provided on an area in which the first electrodes and the second electrodes cross each other; a first electrode driver for driving the first electrodes; a second electrode driver for driving the second electrodes; and a controller for controlling the first electrode driver and the second electrode driver.

The controller includes:

a memory unit for receiving a first vertical synchronous signal, a first horizontal synchronous signal, and an input signal comprising video data, and storing the video data for an image;

a synchronous signal controller for generating a control signal including an on-time information of an on-time for representing gray scales of the image and a blank-time information of a blank-time for representing no gray scales of the image;

a synchronous signal generator for generating a second horizontal synchronous signal based on the signal generated by the synchronous signal controller; and a memory controller for controlling the output of the image that is stored in the memory unit based on the second horizontal synchronous signal input by the synchronous signal generator.

The second horizontal signal may have a period including an active period and an inactive period, the active period being maintained at least during the on-time, and the period of the first horizontal synchronous signal may be determined by the sum of the on-time and the blank-time.

Also, the synchronous signal controller may include a determination unit in which on-time and blank-time are determined and stored by the characteristics of the display panel;

a counter counting the number of reference clock signals corresponding to the on-time saved in the determination unit and the number of reference clock signals corresponding to the blank-time saved in the determination unit;

an output unit outputting a control signal to the synchronous signal generator, the control signal having the number of on-time reference clock signals and the number of blank time reference clock signals.

Moreover the synchronous signal generator may generate a second vertical synchronous signal based on video data, the first vertical synchronous signal, and the second horizontal synchronous signal.

The second vertical synchronous signal may include an active period and an inactive period, the period of the second vertical synchronous signal may correspond to the first vertical synchronous signal, and the duration of the active period may be determined by the second horizontal synchronous signal. Also, the image may be a one frame image and it is stored on the memory unit for each frame and/or the image may be a one line image.

In one exemplary embodiment of the present invention, a display includes:

a display panel having first electrodes provided in a column direction, second electrodes provided in a row direction, and an electron emission source provided on an area in which the first electrodes and the second electrodes cross each other;

a first electrode driver for driving the first electrodes;

a second electrode driver for driving the second electrodes; and a controller configured to externally receive a first vertical synchronous signal, a first horizontal synchronous signal, and an image signal of an image, generate a first vertical synchronous signal and a second horizontal synchronous signal according to a blank-time information of a blank-time for representing no gray scales of the image and an on-time information of an on-time for representing the gray scales of the image, generate a drive signal for driving the display panel based on the second horizontal synchronous signal and the regenerated second vertical synchronous signal, and output the second vertical synchronous signal, the second horizontal synchronous signal, and/or the drive signal to the first electrode driver and the second electrode driver.

The second horizontal synchronous signal may include a period including an active period and an inactive period, the active period may be maintained at least during the on-time, and the period of the second horizontal synchronous signal may be determined by the sum of the on-time and the blank-time.

The second vertical synchronous signal may include a period having an active and an inactive period, the period of the second vertical synchronous signal corresponds to the first vertical synchronous signal, and the duration of the active period is determined by the second horizontal synchronous signal.

BRIEF DESCRIPTION OF THE DRAWINGS

The accompanying drawings, together with the specification, illustrate exemplary embodiment(s) of the present invention, and, together with the description, serve to explain the principles of the present invention.

DETAILED DESCRIPTION

Figure 1:
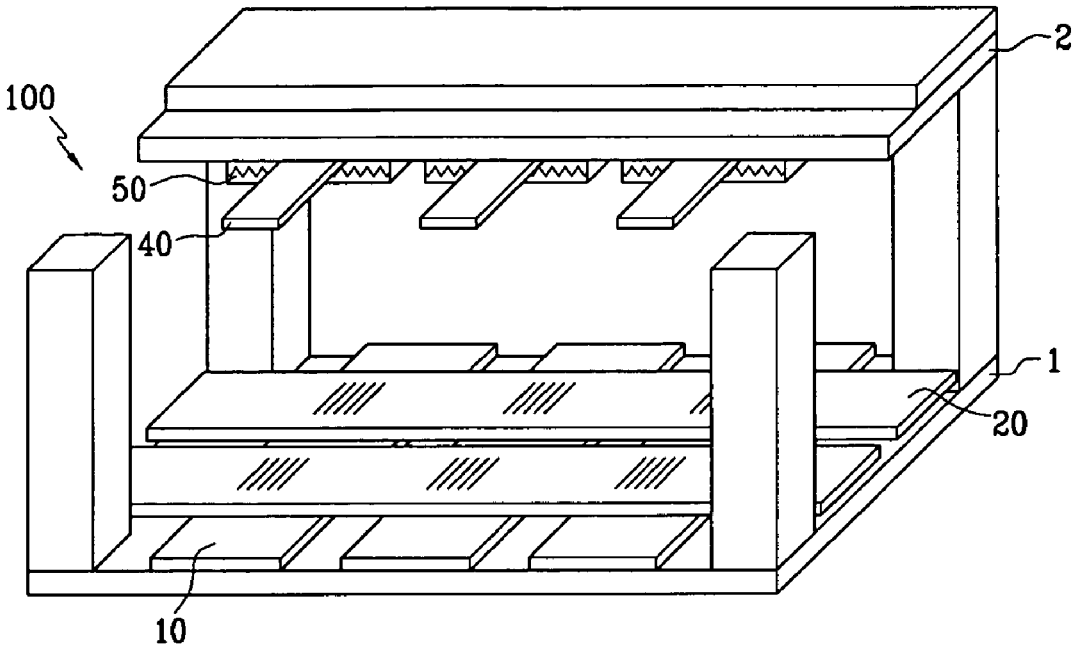
FIG. 1 (Prior Art)
FIG. 1 shows a partial perspective view of a display panel of a conventional EED.
Figure 2:
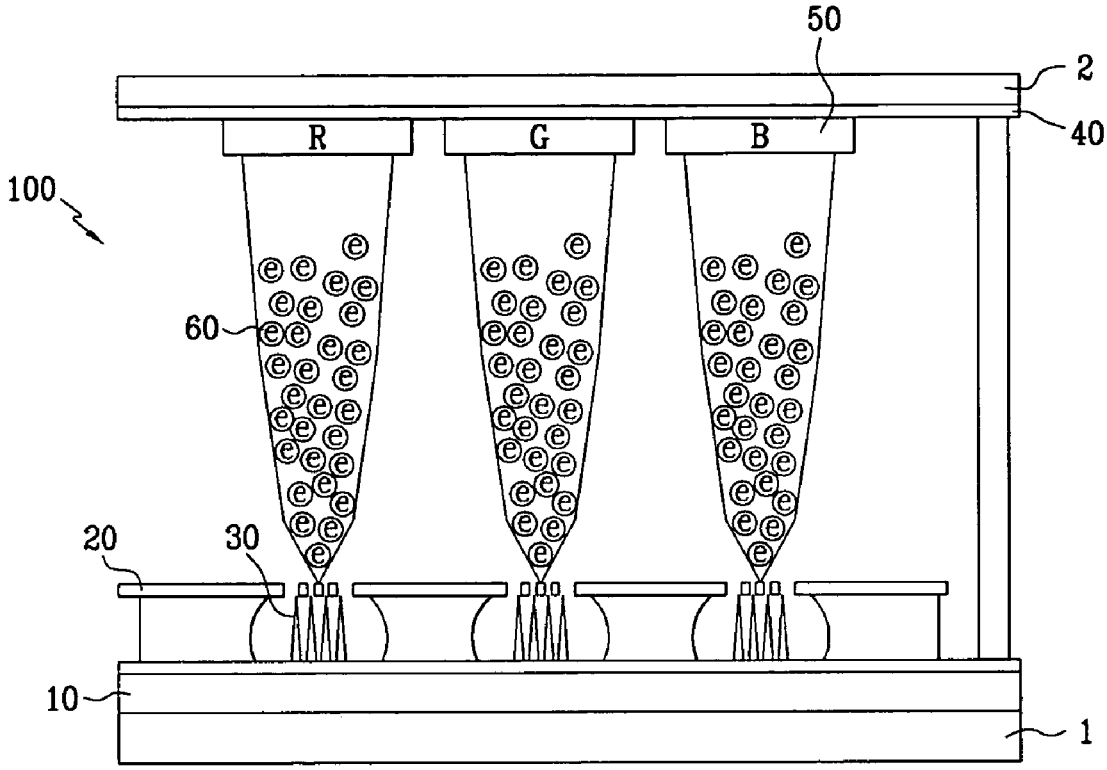
FIG.2(Prior Art)
FIG. 2 shows a cross-sectional view of the conventional EED of FIG. 1.

In the following detailed description, only exemplary embodiment(s) of the present invention are shown and described, by way of illustration. As those skilled in the art would recognize, the described exemplary embodiment(s) may be modified in various ways, all without departing from the spirit or scope of the present invention. Accordingly, the drawings and description are to be regarded as illustrative in nature, and not restrictive. There may be parts shown in the drawings, or parts not shown in the drawings, that are not discussed in the specification as they are not essential to a complete understanding of the invention. Like reference numerals designate like elements.

Figure 3:
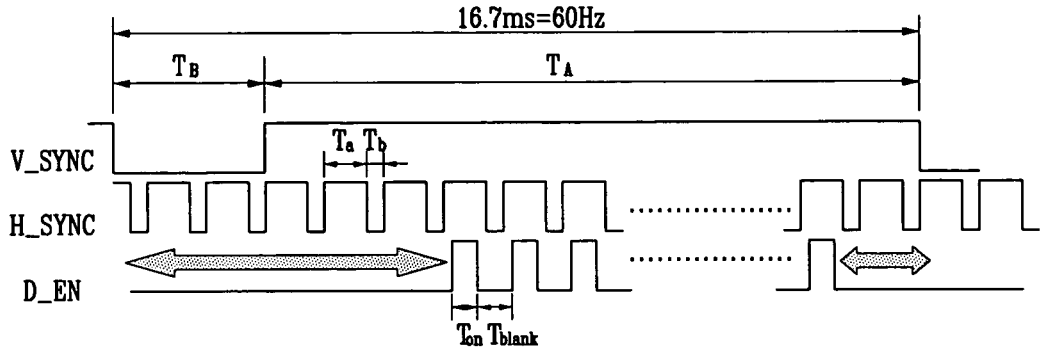
FIG. 3 shows a signal chart for representing a vertical synchronous signal (V_SYNC), a horizontal synchronous signal (H_SYNC), and a display enable signal (D_EN).

First, a synchronous signal and a data signal used for driving an EED will be explained. In particular, FIG. 3 shows a signal chart for representing a vertical synchronous signal (V_SYNC), a horizontal synchronous signal (H_HYNC), and a display enable signal (D_EN). The vertical synchronous signal (V_SYNC) is a signal in which a vertical synchronous period having an active period ($T_A$) and an inactive period ($T_B$) are applied. Video data of a frame are provided in the active period ($T_A$) of the vertical synchronous signal (V_SYNC), and the vertical synchronous period having the active period ($T_A$) and the inactive period ($T_B$) corresponds to the frequency of 60 Hz for representing an image of a frame on a display panel.

The horizontal synchronous signal (H_SYNC) is a signal in which a horizontal synchronous pulse period having an active period ($T_a$) and an inactive period ($T_b$) are consecutively (or sequentially) applied, and line-based images are displayed on the basis of the horizontal synchronous pulse period of the active period ($T_a$) and the inactive period ($T_b$).

The display enable signal (D_EN) includes a plurality of display pulses having an On time ($T_{on}$) for actually representing gray scales for each line, and a blank time ($T_{blank}$) for charging and discharging a panel according to resolution of the display panel, so that images are represented per frame.

Figure 4:
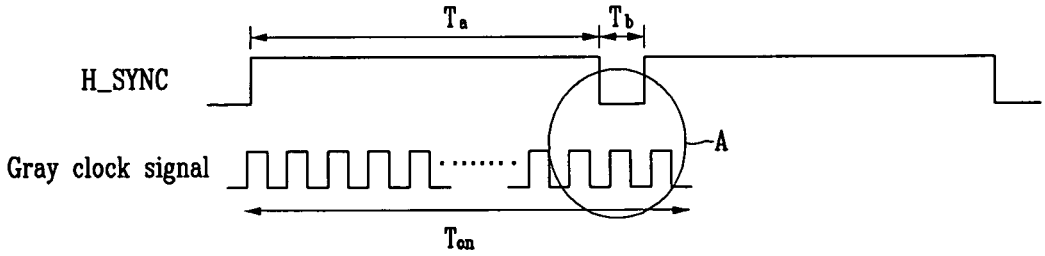
FIG. 4 shows a signal chart for representing gray scale clock signals during an active period ($T_a$) of the horizontal synchronous signal and on-time ($T_{on}$) in detail.

FIG. 4 shows a block diagram for representing the gray scale clock signals during the active period ($T_a$) of the horizontal synchronous signal and the on-time ($T_{on}$), in detail.

Referring now also to FIG. 3, although the blank-time ($T_{blank}$) of the display pulse of the display enable signal (D_EN) can be provided on (or with) both the active period ($T_a$) and the inactive period ($T_b$) of the horizontal synchronous signal, the on-time ($T_{on}$) representing the gray scales of the display image is to be provided in the active period ($T_a$) of the horizontal synchronous signal (H_SYNC).

However, the number of the gray scale clock signals in the active period of the horizontal synchronous signal is determined by PWM (Pulse Width Modulation) for representing the gray scales, and therefore, as shown in FIG. 4, the period of the input horizontal signal may be shorter than the number of gray scale clock signals representing 256 gray scales.

In this case, as shown in a circle A of FIG. 4, some of the gray scale clock signals at the end of the active period ($T_a$) of the horizontal synchronous signals (H_SYNC) and the inactive period ($T_b$) are cut, and the gray scales according to the PWM are not represented as they are, and therefore the image quality displayed on the display panel and the brightness are degraded.

Also, the insufficient horizontal synchronous signal period decreases the blank-time. Therefore, crosstalk is generated on the display panel, the time for charging and discharging by the capacitance of the panel is delayed, and the waveform of the video signal input to the data line and the scan line are distorted.

Therefore, embodiments of an EED according to the present invention controls the period of the horizontal synchronous signal in order to sufficiently provide the on-time ($T_{on}$) and the blank-time ($T_{blank}$) for representing the gray scales.

A first exemplary embodiment of an EED according to the present invention will be described in detail with reference to FIG. 5 and FIG. 6.

Figure 5:
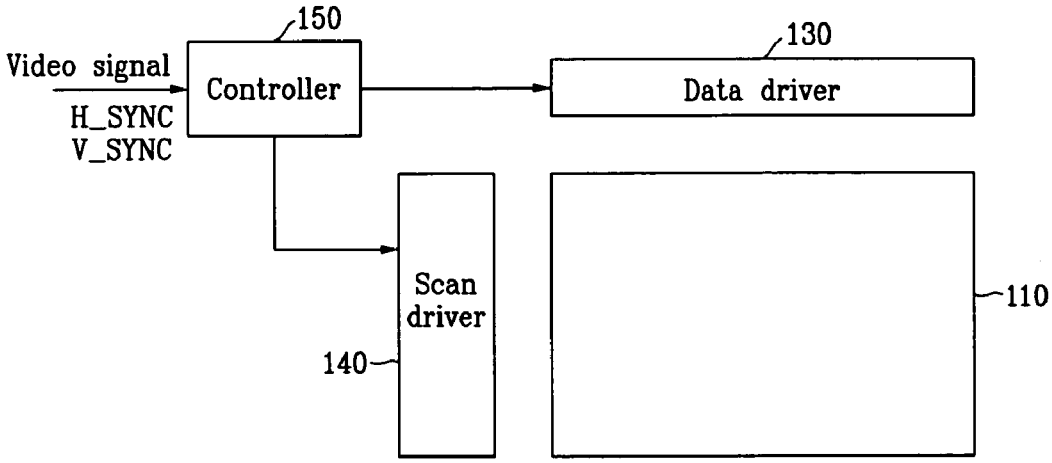
FIG. 5 shows a block diagram for representing a brief configuration of an EED according to a first exemplary embodiment of the present invention.

FIG. 5 shows a block diagram for representing a brief configuration of the EED according to the first exemplary embodiment of the present invention. The EED of the first exemplary embodiment includes a data electrode driver 130 for driving the data electrode, a scan electrode driver 140 for driving the scan electrode, a controller 150, and a display panel 110.

The controller 150 receives RGB (red, green, and blue) data, a vertical synchronous signal (V_SYNC), and a horizontal synchronous signal (H_SYNC); regenerates a horizontal synchronous (Hsync) corresponding to the display panel 110; and applies a scan electrode drive signal and a data electrode driving signal which are generated on the basis of the regenerated horizontal synchronous signal (Hsync) and the video data to the scan electrode driver 140 and the data electrode driver 130.

The scan electrode driver 140 applies a driving voltage for driving the scan electrode to the scan electrode through each scan electrode line, and the data electrode driver 130 applies a driving voltage for driving the data electrode to the data electrode.

Figure 6:
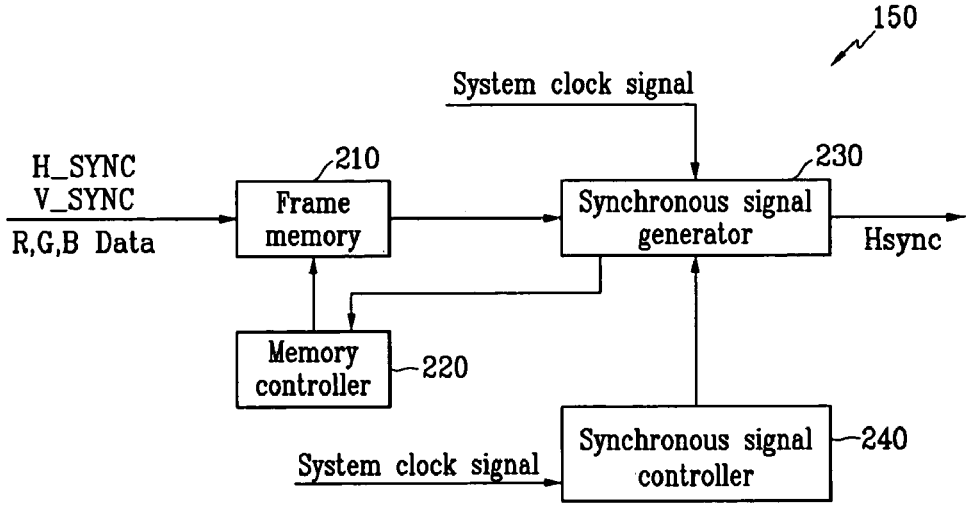
FIG. 6 shows a block diagram for representing a configuration of a controller of the EED of FIG. 5 in detail.

FIG. 6 shows a block diagram for representing, in detail, a configuration of the controller 150 of the EED of FIG. 5.

Referring now to FIG. 6, the controller 150 includes a frame memory 210, a memory controller 220, a synchronous signal generator 230, and a synchronous signal controller 240.

The frame memory 210 receives the horizontal synchronous signal (H_SYNC), the vertical synchronous signal (V_SYNC), and the RGB data, and stores the input video data for each frame.

The frame memory 210 is used in the first exemplary embodiment of the present invention, but the present invention is not thereby limited. For example, a line memory (not shown) for storing the input video data for each line can also be used.

The memory controller 220 controls the reading of the video data stored in the frame memory 210 based on a synchronous signal generated by the synchronous signal generator 230.

The synchronous signal controller 240 outputs a control signal having on-time information for fully representing gray scales according to the PWM (Pulse Width Modulation) on the display panel 110 and blank-time information.

The synchronous signal generator 230 generates the horizontal synchronous signal based on the control signal output by the synchronous signal controller 240, and outputs the horizontal synchronous signal (Hsync).

The following description shows the operation of the controller 150 in more detail.

The frame memory 210 externally receives RGB data, the vertical synchronous signal (V_SYNC), and the horizontal synchronous signal (H_SYNC), and stores the video signal for each frame.

The synchronous controller 240 generates a control signal having on-time information for fully representing the 256 gray scales according to the PWM, and blank-time information for charging and discharging the panel according to the capacitance of the panel, and outputs the control signal to the synchronous signal generator 230.

The control signal is predetermined according to the characteristic of the display panel 110, and is stored in the synchronous signal controller 240. Also, the on-time and the blank-time are determined according to the characteristics of the panel 110 and are stored in the synchronous signal controller 240. Then, the synchronous signal controller 240 counts the number of system clock signals during the stored on-time period, that is, the number of on-time clock signals, and the number of system clock signals during the stored blank-time period, that is, the number of blank-time clock signals. The synchronous signal controller outputs the control signal having the counted number of on-time clock signals and blank-time clock signals to the synchronous signal generator 230.

The synchronous signal generator 230 receives the system clock signals, the vertical synchronous signal and the horizontal synchronous signal from the frame memory 210, and the control signal output by the synchronous signal controller, that is, the number of on-time clock signals and blank-time clock signals. Therefore, the synchronous signal generator 230 generates the horizontal synchronous signal of which the active period ($T_a$) includes a period of more than the number of input on-time clock signals based on the system clock signals.

Figure 7:
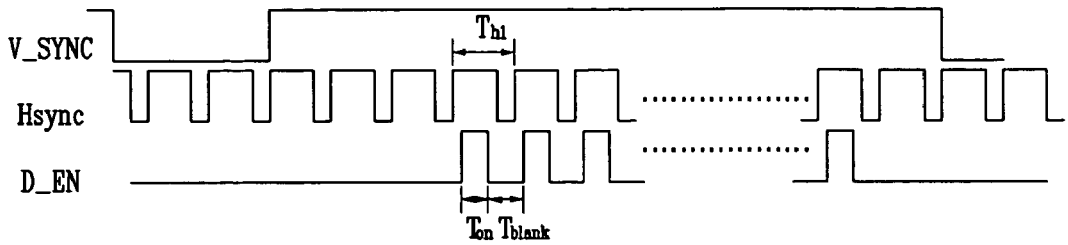
FIG. 7 shows a signal chart for representing a vertical synchronous signal (V_SYNC) externally input and a horizontal synchronous signal (Hsync) generated by the first exemplary embodiment of the present invention.

FIG. 7 shows a signal chart for representing an externally input vertical synchronous signal (V_SYNC) and a horizontal synchronous signal (Hsync) generated by the synchronous signal generator 230 of FIG. 6.

Based on Equation 1, a horizontal synchronous pulse period ($T_{h1}$) of the horizontal synchronous signal is provided.

$$\text{Pulse period } (T_{h1}) = \text{the number of on-time clock signals} + \text{the number of blank-time clock signals.} \quad \text{[Equation 1]}$$

As shown, the synchronous signal generator 230 of the controller 150 regenerates the horizontal synchronous signal (Hsync) having the pulse period corresponding to the on-time ($T_{on}$) determined by the characteristics of the display panel and the blank-time ($T_{blank}$), and therefore, although the input horizontal synchronous signal is varied and modified, the horizontal synchronous signal for representing the gray scales in the display always has constant and stable horizontal synchronous pulse periods. Therefore, the desired gray scales and the brightness are represented, and the exact blank-time is provided according to the characteristics of the capacitance of the panel.

That is, since the EED according to the first exemplary embodiment represents the images using the PWM based on the pulse period of the regenerated horizontal synchronous signal (Hsync instead of H_sync), constant on-time and blank-time are always provided irrespective of the externally input horizontal synchronous signal. Therefore the brightness and the gray scales of the input video data are represented stably.

Also, the blank-time is determined according to the characteristics of the brightness of the panel and the blank-time, that is, the minimum time for charging and discharging is always maintained, and the distortion of the waveforms applied to the panel is decreased, therefore the panel (e.g., the panel 110) is prevented from distortion of the waveforms.

The EED according to a second exemplary embodiment of the invention will now be described. Differing from the first embodiment, the second exemplary embodiment of the present invention regenerates a horizontal synchronous signal as well as a vertical synchronous signal.

According to the first exemplary embodiment, the active period ($T_a$) of the horizontal synchronous signal (Hsync) is a longer period than the number of on-time clock signals. When the horizontal synchronous pulse period configured by the active period ($T_a$) and the inactive period ($T_b$) includes the sum of the number of on-time clock signals and blank-time clock signals, the pulse period of the horizontal synchronous signal (Hsync) can be longer than the pulse period of the externally input horizontal synchronous signal (H_SYNC). On the other, a display enable signal for representing video data of a frame is to be provided in the active period ($T_A$) of the vertical synchronous signal (V_SYNC), and therefore, a predetermined least number of horizontal synchronous pulses corresponding to the resolution (n) of the display panel is to be provided in the active period ($T_A$) of the vertical synchronous (V_SYNC). However, the regenerated horizontal synchronous signal (Hsync) has a longer pulse period than the pulse period of the externally input horizontal synchronous signal (H_SYNC). Therefore, when the predetermined number of pulses corresponding to the resolution n of the display panel is provided, the display enable signal for representing video data of a frame may be longer than the active period ($T_A$) of the externally input vertical synchronous signal (V_SYNC).

Figure 8A:
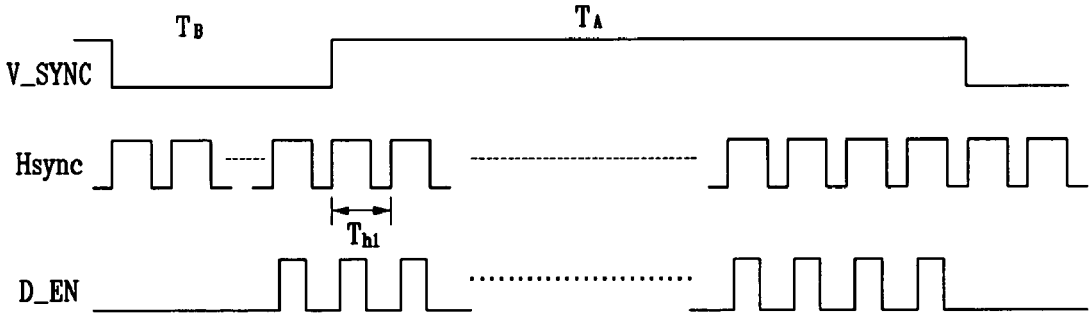
FIG. 8A shows a signal chart for representing a case that a display-enable-signal for displaying video data of a frame exceeds the active period of the vertical synchronous signal.

FIG. 8A shows a signal chart for representing a case in which the display enable signal for displaying the video data of a frame exceeds the active period of the vertical synchronous signal as the pulse period of the horizontal synchronous signal increases.

To prevent the case shown on FIG. 8A, the EED according to the second exemplary embodiment of the present invention generates the vertical synchronous signal (Vsync) with the increased active period ($T_A$) according to the regenerated horizontal synchronous signal (Hsync).

The EED according to the second exemplary embodiment substantially corresponds to the EED according to the first exemplary embodiment, except for generating the vertical synchronous signal (Vsync) by the synchronous signal generator signal. Therefore, to clarify the second exemplary embodiment of the present invention, certain parts for which similar descriptions of the first exemplary embodiment have already been provided are omitted in the following descriptions.

Figure 9:
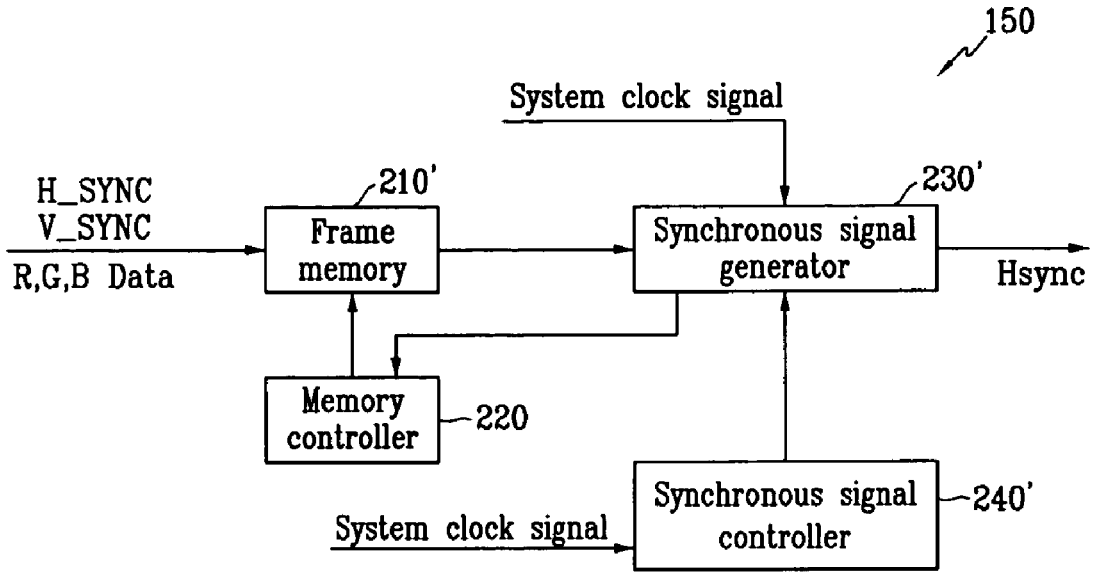
FIG. 9 showns a block diagram for representing a configuration of a controller according to the second exemplary embodiment of the present invention.

Referring now to FIG. 9, a controller (similar to the controller 150 of FIG. 5) according to the second exemplary embodiment of the present invention includes a synchronous signal generator 230'. The synchronous signal generator 230' according to the second exemplary embodiment receives the system clock signal, the horizontal synchronous signal (H_SYNC) and the vertical synchronous signal (V_SYNC) from a frame memory 210', and a control signal output by a synchronous signal controller 240', that is, a number of on-time clock signals and blank-time clock signals. Therefore, the synchronous signal generator 230' generates a horizontal synchronous signal (Hsync) of which the active period ($T_a$) includes a period of more than the number of input on-time clock signals based on the system clock signals.

In addition, the synchronous signal generator 230' of the second exemplary embodiment determines the number of horizontal synchronous pulses of the horizontal synchronous signal based on the resolution of the display panel, and determines the active period ($T_A$) of the vertical synchronous signal including at least the pulse number of the determined horizontal synchronous signal.

A vertical synchronous signal (V_SYNC) for establishing the period except the active period ($T_A$) of the vertical synchronous signal determined during the period of the input vertical synchronous signal (V_SYNC) as an inactive period ($T_B$) is regenerated.

Figure 8B:
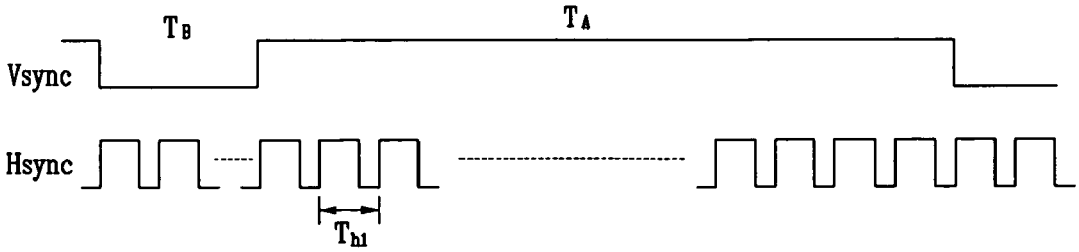
FIG. 8B shows a signal chart for representing the vertical synchronous signal (Vsync) generated by a second exemplary embodiment of the present invention and the horizontal synchronous signal (Hsync).

FIG. 8B shows a signal chart for representing the horizontal synchronous signal (Hsync) and the vertical synchronous signal (Vsync) generated by the synchronous signal generator 230' of the second exemplary embodiment.

The period of the vertical synchronous signal (Vsync) generated by the synchronous signal generator 230' corresponds to the period of the vertical synchronous signal (V_SYNC), the inactive period of the vertical synchronous signal generated by the synchronous signal generator is shorter than the vertical synchronous signal (V_SYNC), and the active period of the vertical synchronous signal generated by the synchronous signal generator is longer than the vertical synchronous signal (V_SYNC).

In this instance, the duration of the inactive period ($T_B$) of the regenerated vertical synchronous signal (Vsync) is established according to the refresh time of each frame required for driving a panel (e.g., the panel 110 of FIG. 5).

The video data are displayed on the basis of the horizontal synchronous signal and the regenerated vertical synchronous signal, and therefore, although the externally input synchronous signal is varied, the display panel is stable and the corresponding characteristics of the brightness and the gray scales are represented.

While the invention has been described in connection with certain exemplary embodiment(s), it is to be understood by those skilled in the art that the invention is not limited to the disclosed embodiment(s), but, on the contrary, is intended to cover various modifications included within the spirit and scope of the appended claims and equivalents thereof.

In general and according to certain exemplary embodiments of the present invention, since an image is displayed using a PWM based on a pulse period of a regenerated horizontal synchronous signal, a constant on-time and blank-time can always be provided irrespective of a horizontal synchronous signal that is externally input. Therefore the brightness and the gray scales of input video data are represented stably.

Also, the blank-time is determined according to the characteristics of the brightness of a panel for displaying the image, and the blank-time, that is, the minimum time for charging and discharging, is always maintained. Therefore, the distortion of the waveforms applied to the panel is decreased, and the panel is prevented from being distorted by the waveforms.

Further in certain exemplary embodiments of the present invention, a vertical synchronous signal corresponding to the regenerated horizontal synchronous signal is regenerated, and the image is displayed using the PWM based on the pulse period of the regenerated vertical synchronous signal and the horizontal synchronous signal, and therefore, although the externally input synchronous signal is varied, the image to be displayed by the display panel can still be stable and the corresponding characteristics of the brightness and the gray scales can be properly represented. Also, a duration of the inactive period ($T_B$) of the regenerated vertical synchronous signal (Vsync) is provided according to the refresh time of each frame required when the panel is driven, therefore the panel can be even more stable (or be even more less distorted).

What is claimed is:

1. A display comprising:

a display panel having first electrodes, second electrodes, and an electron emission source provided on an area in which the first electrodes and the second electrodes cross each other;

a first electrode driver for driving the first electrodes; a second electrode driver for driving the second electrodes; and a controller for controlling the first electrode driver and the second electrode driver using Pulse Width Modulation, wherein the controller comprises:

a memory unit for externally receiving a first vertical synchronous signal, a first horizontal synchronous signal, and an input signal comprising video data, and storing the video data for an image;

a synchronous signal controller for generating a control signal comprising an on-time information of an on-time for representing gray scales of the image and a blank-time information of a blank-time for representing no gray scales of the image;

a synchronous signal generator for generating a second horizontal synchronous signal based on the control signal generated by the synchronous controller; and a memory controller for controlling the output of the image stored in the memory unit based on the second horizontal synchronous signal input by the synchronous signal generator.

2. The display of claim 1, wherein the second horizontal synchronous signal comprises a period including an active period and an inactive period, and the active period is maintained during at least the on-time.

3. The display of claim 2, wherein the period of the second horizontal synchronous signal is determined by the sum of the on-time and the blank-time.

4. The display of claim 1, wherein the synchronous signal controller comprises:

a determination unit for determining and storing the on-time and the blank-time based on characteristics of the display panel;

a counter for counting a number of reference clock signals corresponding to the on-time and the blank-time stored in the determination unit; and an output unit for outputting a control signal to the synchronous signal generator, the control signal comprising the number of reference clock signals of the on-time and the blank-time.

5. The display of claim 1, wherein the synchronous signal generator further generates a second vertical synchronous signal based on the first vertical synchronous signal and the video data.

6. The display of claim 5, wherein a period of the second vertical synchronous signal comprises an active period and an inactive period corresponding to the first vertical synchronous signal, and the duration is determined according to the second horizontal synchronous signal.

7. The display of claim 5, wherein the image comprises a one frame image.

8. The display of claim 1, wherein the image comprises a one line image.

9. A display comprising:

a display panel having first electrodes, second electrodes, and an electron emission source provided on an area in which the first electrodes and the second electrodes cross each other;

a first electrode driver for driving the first electrodes;

a second electrode driver for driving the second electrodes; and a controller configured to receive an input signal comprising an image signal of an image, a first vertical synchronous signal, and a first horizontal synchronous signal; generate a second vertical synchronous signal and a second horizontal synchronous signal based on a blank-time information of an blank-time for representing no gray scales of the image and an on-time information of an on-time for representing the gray scales of the image; generate a drive signal for driving the display based on the second vertical synchronous signal and the second horizontal synchronous signal that are regenerated; and output the second vertical synchronous signal, the second horizontal synchronous signal, and/or the drive signal to the first electrode driver and the second electrode driver.

10. The display of claim 9, wherein the second horizontal synchronous signal comprises a period including an active period and an inactive period, and the active period is maintained at least during the on-time.

11. The display of claim 10, wherein the second horizontal synchronous signal is determined by the sum of the on-time and the blank-time.

12. The display of claim 9, wherein the second vertical synchronous signal comprises a period including an active period and an inactive period and wherein the period including the active period and the inactive period of the second vertical signal corresponds to the first vertical synchronous signal, and the duration of the active period is determined according to the second horizontal synchronous signal.

13. A method for controlling a display, the display having a display panel that has first electrodes, second electrodes, and an electron emission source provided on an area in which the first electrodes and the second electrodes cross each other, the method comprising:

receiving an input signal comprising an image signal of an image, a first vertical synchronous signal, and a first horizontal synchronous signal;

generating a second vertical synchronous signal and a second horizontal synchronous signal based on a blank-time information of a blank-time that represents no gray scales of the image and an on-time information of an on time that represents the gray scales of the image;

generating the drive signal for driving the display based on the second vertical synchronous signal and the second horizontal synchronous signal that are regenerated; and outputting the second vertical synchronous signal, the second horizontal synchronous signal, and/or the driver signal to a first electrode driver and a second electrode driver, wherein the first electrode driver is for driving the first electrodes and the second electrode driver is for driving the second electrodes.

14. The method of claim 13, wherein the second horizontal synchronous signal comprises a period including an active period and an inactive period, the period including the active period and the inactive period of the second horizontal signal corresponds to the first horizontal synchronous signal, and the active period is maintained at least during the on-time.

15. The method of claim 14, wherein the second horizontal synchronous signal is determined by the sum of the on-time and the blank-time.

16. The method of claim 15, wherein the second vertical synchronous signal comprises a period including an active period and an inactive period and wherein the period including the active period and the inactive period of the second vertical signal corresponds to the first vertical synchronous signal, and the duration of the active period of the second vertical synchronous signal is determined according to the second horizontal synchronous signal.

17. The method of claim 13, wherein the second horizontal synchronous signal is determined by the sum of the on-time and the blank-time.

18. The method of claim 17, wherein the second vertical synchronous signal comprises a period including an active period and an inactive period and wherein the period including the active period and the inactive period of the second vertical signal corresponds to the first vertical synchronous signal, and the duration of the active period is determined according to the second horizontal synchronous signal.

19. The method of claim 13, wherein the second vertical synchronous signal comprises a period including an active period and an inactive period and wherein the period including the active period and the inactive period of the second vertical signal corresponds to the first vertical synchronous signal, and the duration of the active period is determined according to the second horizontal synchronous signal.

20. The method of claim 19, wherein the second horizontal synchronous signal comprises a period including an active period and an inactive period, the period including the active period and the inactive period of the second horizontal signal corresponds to the first horizontal synchronous signal, and the active period of the second horizontal synchronous signal is maintained at least during the on-time.

* * * * *